United States Patent [19]

Linnemann et al.

[11] Patent Number: 4,917,289

[45] **Date of Patent: * Apr. 17, 1990**

[54] BULK CONTAINER BASE CONSTRUCTION

[75] Inventors: Kent A. Linnemann, Cincinnati; Richard H. McKinzie, Bethel, both of Ohio

[73] Assignee: Shippers Paper Products Company, Cincinnati, Ohio

[ * ] Notice: The portion of the term of this patent subsequent to Nov. 21, 2006 has been disclaimed.

[21] Appl. No.: 326,511

[22] Filed: Mar. 21, 1989

Related U.S. Application Data

[63] Continuation-in-part of Ser. No. 148,928, Jan. 27, 1988, Pat. No. 4,881,683.

[51] Int. Cl.[4] ..... B65D 90/02; B65D 88/52

[52] U.S. Cl. ..... 229/109; 220/1.5; 220/441; 229/117; 229/125.26

[58] Field of Search ..... 220/1.5, 462–465, 220/441, 446, 466, 443; 229/125.26, 23 R, 109, 110, 41 C, 23 BT, 117

[56] References Cited

U.S. PATENT DOCUMENTS

| | | | |
|---|---|---|---|
| D. 218,096 | 7/1970 | Craig . | |
| D. 222,252 | 10/1971 | Coleman et al. . | |
| D. 222,253 | 10/1971 | Coleman et al. . | |
| D. 222,254 | 10/1971 | Coleman et al. . | |
| D. 226,481 | 3/1973 | Coleman et al. . | |
| D. 268,249 | 3/1983 | Goedken | D9/375 |
| 1,249,097 | 12/1917 | Huye | 229/125.26 X |
| 1,955,865 | 9/1934 | Wellman | 229/125.26 X |
| 2,620,119 | 12/1952 | George | 229/109 X |
| 2,872,079 | 2/1959 | Moore . | |
| 3,041,942 | 7/1962 | Repking | 229/125.26 X |
| 3,115,292 | 12/1963 | Repking | 229/41 C |
| 3,126,797 | 3/1964 | Carpenter et al. . | |
| 3,433,400 | 3/1969 | Hawkins . | |
| 3,451,610 | 6/1969 | Beichler et al. | 229/109 X |
| 3,460,718 | 8/1969 | Plant . | |
| 3,670,946 | 6/1972 | Croley | 229/4.5 |
| 3,712,530 | 1/1973 | Croley | 229/4.5 |
| 3,724,712 | 4/1973 | Starr et al. . | |
| 3,937,392 | 2/1976 | Swisher | 229/41 |
| 4,019,635 | 4/1977 | Boots | 206/386 |
| 4,157,609 | 6/1979 | Schutz . | |
| 4,165,024 | 8/1979 | Oswalt et al. | 222/105 |
| 4,166,567 | 9/1979 | Beach, Jr. et al. | 229/23 R |
| 4,173,288 | 11/1979 | Schutz | 220/1.5 |
| 4,192,434 | 3/1980 | Conroy | 229/125.26 X |
| 4,359,182 | 11/1982 | Perkins, Jr. | 229/125.26 |
| 4,516,692 | 5/1985 | Croley | 222/105 |
| 4,585,143 | 4/1986 | Fremow et al. | 220/462 |

FOREIGN PATENT DOCUMENTS

| | | | |
|---|---|---|---|
| 603176 | 8/1960 | Canada | 229/125.26 |

*Primary Examiner*—Bryon P. Gehman

*Attorney, Agent, or Firm*—Wood, Herron & Evans

[57] ABSTRACT

A knockdown bulk container for storing and shipping bulk quantities of fluid and semi-fluid substances including an annular base, an annular cap and a circular side wall. The side wall is formed of a number of paperboard slats adhered to a sheet of paperboard. The side wall is adapted to be folded into a substantially flat condition for shipping and storing and formed into a cylinder which is inserted in the annular base for filling of the container. Interlocking blocks adhered respectively to the outside of the base of the side wall and to the inside of the annular base secure the side wall in the base.

2 Claims, 3 Drawing Sheets

BULK CONTAINER BASE CONSTRUCTION

RELATED APPLICATIONS

This application is a continuation-in-part of U.S. Ser. No. 148,928, filed Jan. 27, 1988, now U.S. Pat. No. 4,881,683 entitled "Bulk Container," and assigned to the assignee of this invention.

BACKGROUND OF THE INVENTION

This invention relates to a container for shipping liquids and semi-fluid substances such as adhesives in bulk quantities and, more particularly, to an improved base construction of a bulk container which may be easily assembled and disassembled for use, reuse, disposal, and reclaiming.

In the shipping of quantities of fluids and semi-fluid materials such as adhesives used in industry today, it is common to ship these materials in containers of bulk quantity on the order of 55 gallons and larger whereby the user pumps out or otherwise removes desired quantities of material from the bulk container until empty afterwhich the container can be returned to the manufacturer for reuse or be disposed of or be reclaimed. Typical bulk containers comprise both fiberboard drums having metal tops and bottoms and cardboard containers which are secured to wooden pallets. The drums and containers typically employ a plastic liner which is sealed to contain the material being shipped. At the point of use, the fluid then may be pumped out of the container or drained from the bottom.

Besides the problems of the size, weight and cost of current bulk containers is the problem that such containers exist in a manufactured or erected condition both before and after use. As a consequence, large amounts of space are involved in storing the containers for filling and after filling. In the shipment of containers from the manufacturer to the site where they are to be filled or used, large amounts of shipping space also is entailed. This is true with round containers where typically there is a large amount of void space between containers which is wasted space. After use, when the containers are returned to be refilled, considerable amounts of shipping space are again wasted by virtue of the geometries of the containers. There exists no container commercially available today which is capable of being easily assembled and easily disassembled before and between uses thereby greatly reducing the amount of the storage and shipping space needed for such containers

SUMMARY OF THE INVENTION

The bulk container of the present invention includes a generally cylindrical side wall comprised of a foldable paperboard sheet and a number of vertically aligned paperboard slats which are secured thereto in edge abutting relation, a circular base including an annular base rim, and a cap including a similar annular rim for closing the top of the container. The slats forming the side wall are formed of a plurality of layers of paperboard which is laminated together and folded upon itself to provide a slat of predetermined length and width. The circular base includes, in addition to the annular base rim, a circular center disk such that the base of the cylindrical side wall is insertable in between the annular base rim and the circumferential edge of the circular center disk and wedged therebetween to provide an upright container.

In accordance with a presently preferred form of this invention, pieces of the paperboard slat are secured to the outer circumference of the base of the cylindrical side wall and like pieces are secured to the upper portion of the inner diameter of the annular base rim such that when the circular center disk is in place the base of the side wall is wedged against the annular base rim and the base pieces interlock. As a result, any inward movement of the circular side wall such as on impact during shipping, e.g., by the side wall's being hit by a forklift truck, or the like which would otherwise cause the cylindrical side wall to rise up, and possibly pinch the plastic liner damaging it, will in accordance with / the present invention cause the base pieces to engage and thereby prevent movement of the cylindrical side wall.

To knock down the container to form a relatively compact unit for storage and shipping, all that is required is that the circular center disk be removed from the inside of the cylindrical side wall, the cylindrical side wall be removed from the base rim, and the cylindrical side wall be folded to a substantially flat condition for shipping.

DETAILED DESCRIPTION OF THE INVENTION

Figure 1:
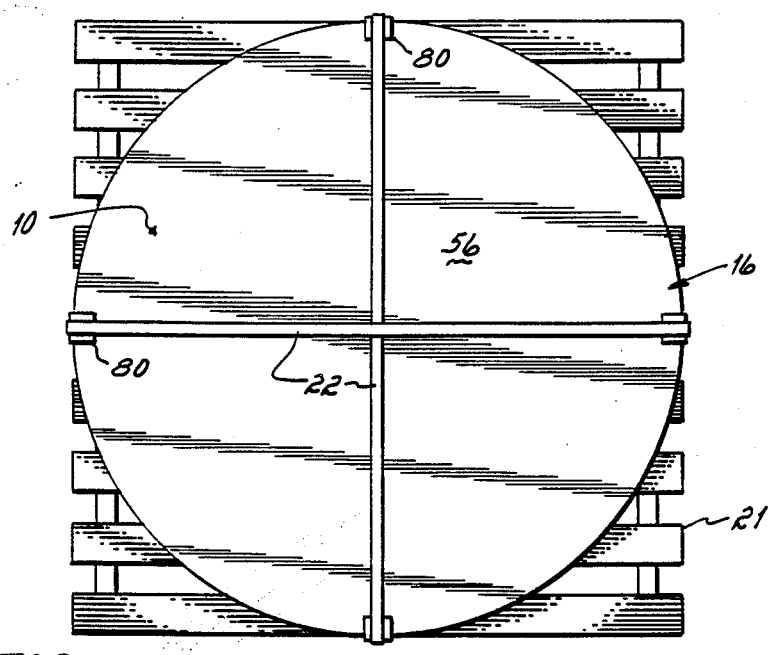
FIG. 1 is a top view of the bulk container of the present invention.
Figure 2:
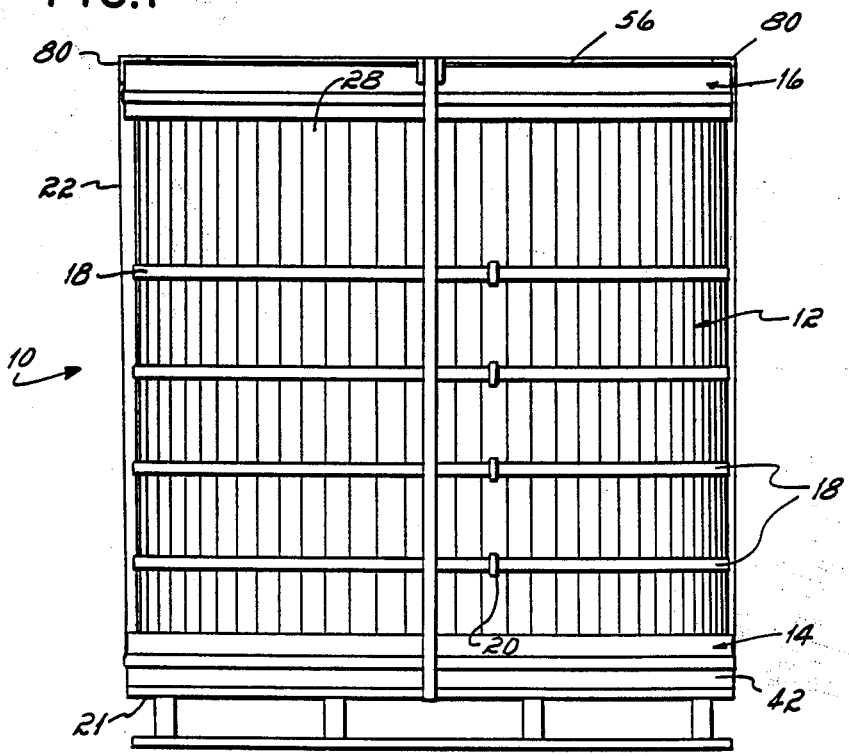
FIG. 2 is a elevation view of the bulk container of the present invention.

Referring now to FIGS. 1 and 2, the bulk container 10 of the present invention includes generally a cylindrical side wall 12 disposed between a circular base 14 and a circular top or cap 16. Metal or plastic bands 18 may optionally encircle the side wall 12 to give the container 10 additional strength to prevent outward bulging of the side wall 12 under the weight of the liquid or fluid contained therein. Likewise, bands 18 may optionally encircle the circular base 14 and circular cap 16. Metal or plastic clips 20 formed in the side wall 12 at locations spaced about the circumference thereof and spaced from top to bottom support the bands 18 in positions spaced vertically along the height of the container. When filled, the bulk container 10 may be secured, if desired, to a wooden pallet 21 permitting its lifting for loading and unloading by a forklift truck. Like metal or plastic bands 22 extend across the top 16 of the container 10 and under the wooden pallet 21 and are tensioned by known strap tensioning tools to secure the bulk container 10 to the pallet 21. Interiorly of the container is a double walled plastic liner 24 (FIG. 3) formed, for example, of polyethylene. When the container is filled, both plies are twisted closed and secured and the cap 16 is placed on top of the container 10 as shown in FIG. 1.

Figure 3:
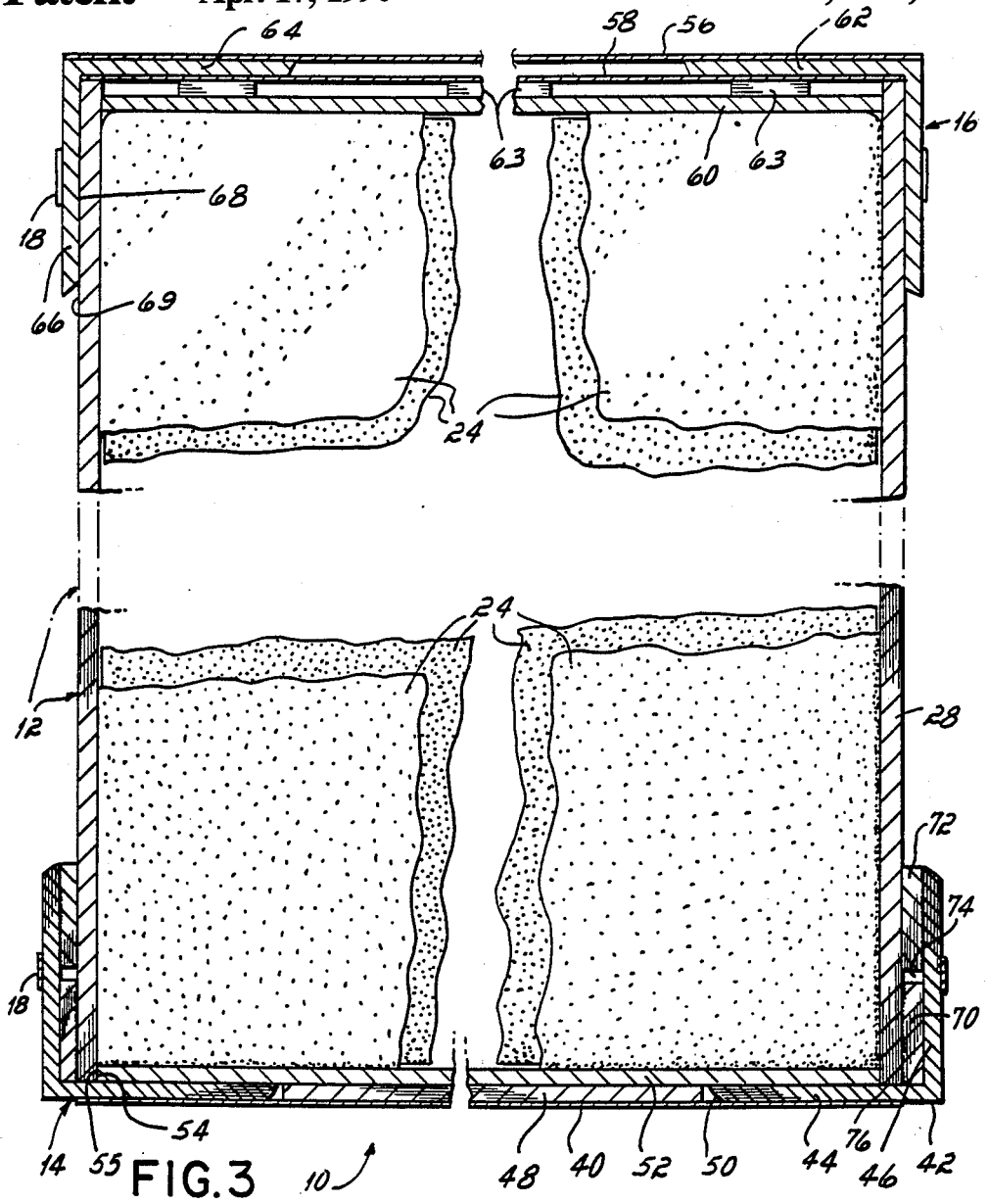
FIG. 3 is a cross-sectional view of the bulk container as shown in FIGS. 1 and 2.
Figure 4:
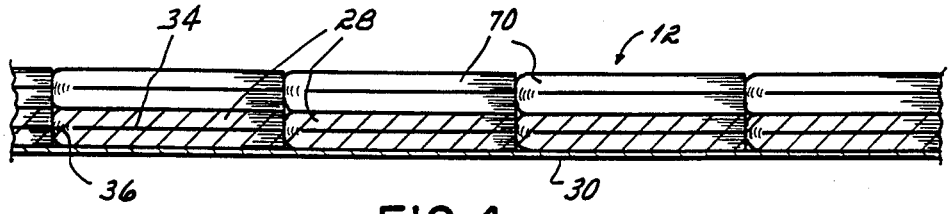
FIG. 4 is a developed view of the side wall of the container prior to shaping.
Figure 6:
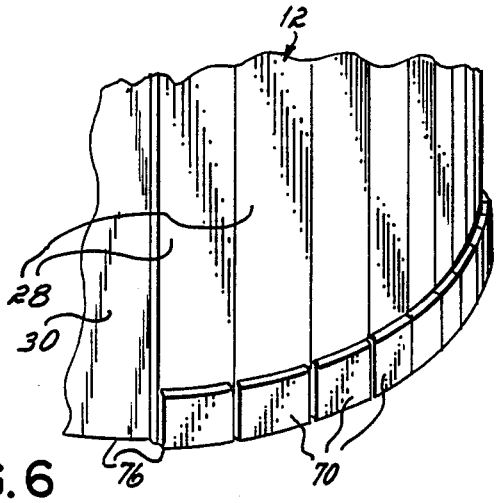
FIG. 6 is a partial pictorial view showing the base of the bulk container side wall.

Referring now to FIG. 3, there is shown a cross-sectional view of the bulk container 10 of the present invention. As stated, in its general configuration, the bulk container 10 includes a cylindrical side wall 12, a circular base 14, and a circular top or cap 16. Referring in addition to FIGS. 4 and 6, the cylindrical side wall 12 is formed of a series of paperboard slats 28 (hereinafter described in detail) which are adhered in a vertical direction in substantially edge abutting relationship to the one surface of a single sheet of two-ply laminated paperboard 30.

Figure 4A:
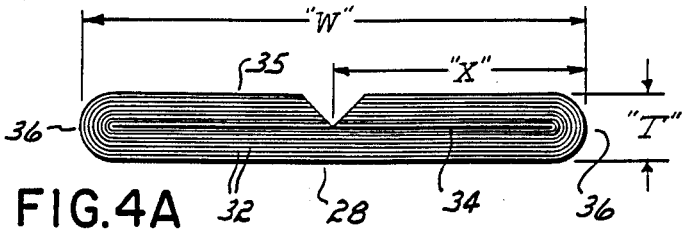
FIGS. 4A and 4B are diagrammatic illustrations of the slats forming a portion of the side wall of the bulk container shown in FIG. 4.
Figure 4B:
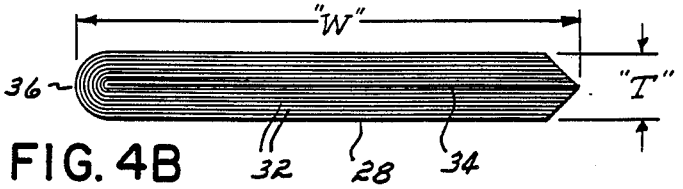

Referring now in addition to FIGS. 4A and 4B, the construction of the paperboard slats 28 of the present invention are shown in more detail. Each slat 28 is formed generally of an extended length by bringing together from multiple rolls sheets of paperboard and laminating them together with a suitable adhesive such as a sodium silicate slurry. The laminated sheets of paperboard are then folded along one or more fold lines 36 and the facing sheets fully pressed together such that the facing sheets are substantially coextensive one with another along an interface 34. A suitable adhesive is used to join the sheets together to form the final article. When the adhesive is set, the slats may then be cut to a desired length. As described below, the thickness of the resulting slats is a function of the number and thickness of the paperboard plies, and the width is a function of the width of the webs of paperboard used to form the slats. The facing sheets of the laminate on folding may be secured together by means of a similar adhesive, i.e., sodium silicate or a hot melt adhesive. In any event, the laminate must be formed and folded while the individual plies thereof are sufficiently slidable one with another to permit the folding. It has been found that such a construction provides a substantially warp-free paperboard member 28 which has a relatively high beam strength and resistance to deflection.

The paperboard slats 28 may be formed of various configurations. Two alternatives are illustrated by FIGS. 4A and 4B, respectively. In each embodiment, multiple plies 32 of paperboard are laminated and glued together. This laminated paperboard is then folded upon itself and glued thereto along the interface 34 to provide a slat having a width "W" and a thickness "T". As seen, the slat 28 has at least one rounded edge along the fold line 36 (FIG. 4B) or a pair of rounded edges along fold lines 36 (FIG. 4A). Although the slats 28 could be formed of a width "W" merely by laying up and laminating multiple plies of paperboard of width "W", it has been found that exceptional beam strength in the slat is provided by first laminating the multiple plies and then folding the element upon itself and gluing it to itself along line 34. This fold gives the slat more strength using the same amount of paper or the same strength with less paper than merely laminating multiple plies. Moreover the resulting product has been found to be surprisingly warp-free.

In FIG. 4A, the slat 28 is formed by folding two side edges of width "X" ("X" equalling "W"/2) and thickness "T"/2 together and laminating them to the center section to provide a overall width "W" and thickness "T". In a presently preferred form of the invention, the dimension "W" is on the order of ½" to 4" and the thickness "T" from about 0.040" to 0.40".

It has been found that the embodiment shown in FIG. 4A has certain advantages over that shown in FIG. 4B in that the double fold tends to lessen warpage and give a more even product. Additionally, in the embodiment shown in FIG. 4A, a single sheet of paperboard may be placed over the top surface 35 to provide uniformity or the outer paperboard ply of one of the folded portions can be extended over the other folded portion The paperboard slat may be formed in several alternative fashions. One is to bring together a number of plies of paperboard from individual rolls, glue them together, press the members together, form the resulting product first into a right angle and then press the legs of the angle together with an adhesive therebetween to form the folded structure as shown in FIGS. 3 and 4A and 4B. In this operation, the adhesive joining the sheets together has not been permitted to dry such that the sheets of laminated paper may still slip one with another to permit the folding of the plies. In an alternative method of manufacture, the laminated plies may be first formed into a right angle. Thereafter, while again the adhesive is sufficiently moist to permit slippage of the plies that right angle can then be pressed in a separate operation to form the slat construction. In this method of manufacture, a hot melt adhesive has been used to secure the facing sheets on their folding together across their respective surfaces, the hot melt providing a relatively short open period whereby adhering of the facing sheets can be accomplished before the legs of the angle have an opportunity to separate.

As stated, the warp-free paperboard slats 28 are adhered with a suitable adhesive to the outside surface of the paperboard sheet 30 forming the side wall 12 with the slats 28 long direction running in the vertical direction of the bulk container 10. The slats 28 are in essentially edge abutting relationship to provide a structural side wall for the container. Selected spaced slats are provided with metal or plastic clips 20 placed therein at periodic intervals along their length which support the circumferential bands 18 for filling of the container. It has been found in addition to the relative high beam strength of the paperboard slats 28 that they provide good resistance to puncturing of the side wall when the container is filled with liquid.

Referring again to FIG. 3, the base 14 of the bulk container 10 is formed of a base sheet 40 to which is secured an annular paperboard rim 42. The annular rim 42 is formed of a paperboard angle of a thickness in the range of 0.225 to 0.250 inch. The horizontal leg 44 of the angle is cut (FIG. 5) to permit the angle to be bent into an annulus including an upstanding annular leg 46 about the base of the container comprised of the leg 46 of the angle opposite the horizontal leg 44. The cut horizontal legs 44 are glued to the base sheet 40 about its periphery. An intermediate circular sheet 48 is then glued to the base sheet 40 interiorly of the interior edge 50 of the horizontal leg 44 of the rim 42 to provide a substantially continuous horizontal plane across the member 14. A top circular center disk 52 having an outer diameter 54 slightly greater than the inner diameter 55 side wall 12 is insertable inside the base of the side wall 12 and is supported on the intermediate circular member 48 and the horizontal leg 44 of the rim 42.

At the top of the container is a top or cap 16. The cap includes an optional top circular cap member 56, an intermediate circular cap member 58, a bottom circular cap member 60, and an annular rim 62. Paperboard or cardboard blocks 63 are interposed between cap member 58 and cap member 60. In one construction, the blocks 63 may be glued to member 58, and member 60 in turn glued to the blocks 63. The cap member 60 has a diameter slightly less than the inner diameter of the side wall 12 such that it fits inside the side wall, as shown in FIG. 3, when in place on the container, but functions to conform the top of the container side wall to its generally circular configuration. The rim 62 is also formed of a paperboard angle of a thickness in the range 0.225 to 0.250 inch, which is likewise cut along one leg 64 to form segments permitting the angle to be bent into an annulus such as with respect to the base rim 42. The cut portions of the leg 64 are adhered to the top cap members 56 and 58 with the opposing leg 66 of the angle providing a downwardly projecting annular leg 66 of the rim 62. The inner diameter 68 of the downwardly projecting leg 66 is slightly greater than that of the outer diameter 69 of the side wall 12 such that when the cap 16 is inserted in position, the leg 66 slides outside the top of the container side wall 12. Except for dimensions, the rim 62 of the cap 16 is essentially the same construction as the rim 42 of the base 14 with respect to the items described above.

Figure 5:
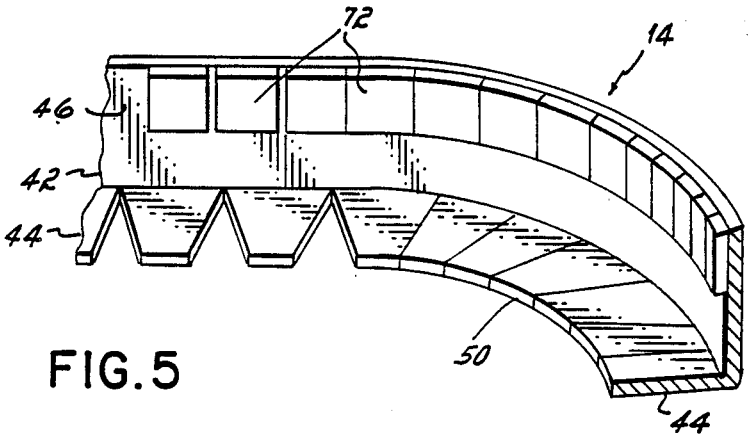
FIG. 5 is a partial pictorial view showing the annular base rim.

Referring again to FIGS. 3, 4 and in addition to FIGS. 5 and 6, at the base of the cylindrical side wall, a first set of blocks 70 are glued to the base of the individual side wall slats 28. These blocks are of a width generally equalling the width of the slats 28 but of a height less than the height of the upright leg 46 of the annular base rim 42, e.g., about 2" when the leg 46 is about 4" high. Advantageously, the blocks 70 are formed of the same material forming the slats 28 and are glued thereto about the base of the side wall as shown most clearly in FIG. 6. On the upper inner wall of the leg 46, a like set of second blocks 72 are glued to the top portion of leg 46. A slight space 74 (exaggerated in FIG. 3 for illustration) may exist between the first and second blocks 70 and 72. The purpose of the blocks 70 and 72 is to provide an interlock such that if an inwardly directed force is placed against the side wall 12, which would unless prevented lift the side wall from its position shown in FIG. 3 including lifting its bottom edge 76 upwardly from leg 44, the blocks 70 engage the blocks 72 to prevent any lifting of the side wall. Accordingly, pinching of the polyethylene liner 24 between the base of the side wall and either the center disk 52 or leg 44 is prevented. Such pinching could unless prevented cause a leak in the liner. Other materials such as wood, particle board, Masonite, and the like can be used to form the blocks 70, 72.

One of the principal advantages of the bulk container of the present invention is its ability to be assembled and disassembled, as needed, thereby creating substantial savings in shipping and storing space. That is, the bulk container comprises essentially three structural units: the side wall 12, the base 14, and the cap 16. The side wall 12, which is formed of the paperboard slats 28 adhered to a paperboard sheet 30 and blocks 70, is capable of being folded upon itself to provide a substantially flat member in the knockdown condition. The base 14 and the cap 16 may be shipped together as a unit, e.g., by being joined together by a piece of stretch wrap plastic film. The plastic liner 24 is advantageously folded and stored between or inside either the cap 16 and base 14. In addition, the bands 18 may be folded and stored with the liner 24 in the cap 16 or base 14. The folded side wall 12 and cap 16 and base 14 with liner 24 and bands 18 therein can thus be shipped in a compact unit.

To assemble the bulk container 10, the cap 16 and the base 14 are separated and the liner 24 and bands 18 removed. The side wall 12 is placed on end and formed into a cylinder and inserted in the base 14 with end 76 resting on leg 44 of the rim 42. On insertion, the side wall blocks 70 are positioned beneath the blocks 72 and in close abutting relation to the blocks 72 and to the leg 46 of the rim 42. Likewise, blocks 72 abut the side wall 12. The circular center disk 52 is inserted interiorly of the cylindrical side wall 12 and tamped down to force the side wall 12 and blocks 70 against the leg of rim 42.

The bands 18 are then placed in position about the side wall 12 and are supported in vertically spaced positions by the clips 20. The double-walled liner 24 is then unfolded and its top draped over the side wall 12 for filling. After filling with a liquid or other semi-fluid material, the inner and outer sheets of the liner 24 are twisted closed and secured. The cap 16 is then inserted in place with the downwardly projecting rim 66 sliding outside the side wall 12 until the top 16 rests on the top edge of the side wall 12. The entire structure is then secured to the wooden pallet 21 by tensioned bands 22. Edge protectors 80 placed between the bands 22 and cap 16 serve to protect the bands from cutting into the cap 16. As stated, the use of bands 18 is optional. For example, the entire structure could be contained with a tensioned plastic film, e.g., by stretch or shrink wrapping.

In use, the liquid in the container may be pumped out by a tube which extends down to the center of the base. Alternatively, a bottom drain could be applied through the side wall 12 to permit draining of the liquid by gravity.

Once the container is emptied, it may be knocked down for return for refilling, disposal, or reclaiming merely by removing the top cap 16, removing the plastic liner 24, removing the bands 18, removing the side wall 12 from its position in the base 14, and folding the side wall 12 to a substantially flat condition for shipping.

In some applications, it may be desired to secure the base 14 to the side wall 12 or the top 16 to the side wall 12 or both by means of tensioned bands. In the embodiment shown in FIGS. 1 and 2 and described above, the bulk container 10 is secured to a pallet 21 by straps 22 which serve in addition to secure the top 16 and base 14 in position with respect to the side walls 12 as well so that the members do not separate, e.g., during shipping and handling.

Thus having described the invention, what is claimed is:

1. A bulk container comprising:

a base including an annular base rim and a circular center portion having a circumferential edge, said annular base rim being formed of multiple layers of paperboard laminated together and formed into a rigid right angle to provide a first upstanding leg forming an annulus about the base of the container, and a second leg at right angles thereto underlying said center portion, and a generally cylindrical side wall having a top and a base and being comprised of a foldable paperboard sheet and a plurality of vertically aligned paperboard slats secured thereto in substantially edge abutting relation, each said slat comprising a plurality of layers of paperboard laminated together and folded upon itself and laminated to itself to provide a slat of predetermined width and length having at least one rounded edge and being substantially flat, said base of said side wall having a plurality of first blocks attached thereto and being insertable in said annular base rim and wedged in between said first upstanding leg of said annular base rim and said circumferential edge of said center portion of said circular base, said annular base rim including a plurality of second blocks mounted to the inside surface of said first upstanding leg at the top thereof such that when said side wall is inserted in said annular base rim said first and second blocks interlock to prevent unintentional removal of said base of said side wall from said annular base rim.

2. A bulk container comprising:

a circular base including an annular base rim and a circular center disk having a circumferential edge, said annular base rim being formed of multiple layers of paperboard laminated together and formed into a rigid right angle to provide a first upstanding leg forming an annulus about the base of the container, and a second leg at right angles thereto underlying said center disk, and a generally cylindrical side wall having a top and a base and being comprised of a foldable paperboard sheet and a plurality of vertically aligned paperboard slats secured thereto in substantially edge abutting relation, each said slat comprising a plurality of layers of paperboard laminated together and folded upon itself and laminated to itself to provide a slat of predetermined width and length having at least one rounded edge and being substantially flat, said base of said side wall having a plurality of first blocks attached thereto and being insertable inside said first upstanding leg of said annular base rim, said circular center disk being insertable within said base of said side wall with said circumferential edge of said center disk contacting said base of said side wall and wedging said base of said side wall between said circumferential edge and said first upstanding leg of said annular base rim, said annular base rim including a plurality of second blocks mounted to the inside surface of said first upstanding leg at the top thereof such that when said side wall is inserted in said annular base rim said first and second blocks interlock to prevent removal of said base of said side wall from said annular base rim, said side wall being foldable to a substantially flat condition for shipping and storing and being assembleable in said circular base into an upright container.

* * * * *